US005923009A

United States Patent [19]

Cheng

[11] Patent Number: 5,923,009

[45] Date of Patent: Jul. 13, 1999

[54] LATCHABLE INTERLOCK SWITCH

[75] Inventor: W. C. Cheng, Tainan, Taiwan

[73] Assignee: Taiwan Semiconductor Manufacturing Co., Ltd., Hsin-Chut, Taiwan

[21] Appl. No.: 08/844,271

[22] Filed: Apr. 18, 1997

[51] Int. Cl.[6] ..... H01H 9/20

[52] U.S. Cl. ..... 200/50.01; 200/318.2

[58] Field of Search ..... 200/4, 16 R, 16 B, 200/16 C, 17 R, 50.01, 50.02, 43.16, 43.13, 43.18, 308, 310, 312, 318, 318.1, 318.2, 321–325, 327, 341, 520, 573

[56] References Cited

U.S. PATENT DOCUMENTS

| | | | |
|---|---|---|---|
| 2,523,125 | 9/1950 | Ley | 200/54 |
| 2,592,660 | 4/1952 | Crumley | 200/159 |
| 4,182,943 | 1/1980 | Butterworth | 200/159 R |
| 4,206,328 | 6/1980 | Coyle et al. | 200/44 |
| 4,636,602 | 1/1987 | Hall et al. | 200/153 SC |
| 4,956,983 | 9/1990 | Okamura et al. | 70/241 |
| 5,055,643 | 10/1991 | Pardini et al. | 200/318.2 |
| 5,593,022 | 1/1997 | Schaeffer et al. | 200/308 |

*Primary Examiner*—Michael A. Friedhofer
*Attorney, Agent, or Firm*—Tung & Associates

[57] ABSTRACT

A latchable interlock switch that can be installed under a cover of a process machine for shutting off a power supply to the machine when the cover is removed is disclosed. The switch can also be latched into a permanently engaged position so that the power supply to the machine remains on even when the cover has been removed to perform a repair or maintenance procedure. The interlock switch may optionally be provided with an indicator lamp to indicate the on/off state of the switch.

18 Claims, 2 Drawing Sheets

LATCHABLE INTERLOCK SWITCH

FIELD OF THE INVENTION

The present invention generally relates to an interlock switch installed under a cover of a process machine for shutting off a power supply to the machine when the cover is removed and more particularly, relates to an interlock switch that can be latched into a permanently engaged position and optionally, equipped with an indicator lamp such that the power remains on even when the cover has been removed to facilitate a repair or maintenance procedure to be conducted on the machine.

BACKGROUND OF THE INVENTION

In many electrically operated machines, the operating components of the machine are concealed behind a outer cover such that a user of the machine would not be exposed to any of such components. This is designed from both an expediency and safety point of view such that it protects the operating components of the machine from being tampered with by users who may not be qualified to service such components and furthermore, to protect an operator from being exposed to such components that carry live electricity. To achieve such objective, the outer cover of the machine is designed to engage interlock switches that are installed in the machine which are normally engaged (or pushed down) by the outer cover such that power supply to the machine is not interrupted. The interlock switches have been used in a variety of electrically operated machines such as an office copy machine or a large variety of semiconductor process machines.

The interlock switches are frequently constructed of two parts. First, a mechanical component that consists of a shaft mounted on a spring that can be moved up and down and secondly, an electrical switch that can be switched on or off by the shaft with a very small force, i.e., a microswitch. The microswitch can be designed as an integral part of the mechanical component or as an attachment external to the mechanical component. For instance, the mechanical component can be a cylindrical shaft positioned in a hollow housing and loaded by a spring element such that when the shaft is in an extended position and not pushed down by a machine cover, the microswitch is disengaged (or deactivated) to provide a bypass circuit which possibly includes a warning lamp to indicate that the power supply to the machine has been interrupted. After an outer cover is reinstalled on the process machine, the shaft of the mechanical part is pushed down to engage (or activate) the microswitch such that a current flows through the process machine to provide power. A process machine thus designed incorporating a plurality of interlock switches enables an operation of the machine in an intended manner.

During the normal operation of a process machine, the machine may malfunction and necessitates a repair procedure to be conducted. Similarly, routine preventive maintenance procedures may also be required on process machines, for instance, replacing heating lamps before they are burned out or other expansible parts that are subjected to deterioration with usage. In either event, a power supply to the machine can not be interrupted when the outer cover of the machine is removed so that a repairman can diagnose the cause of a problem or in the case of a preventive maintenance work, to make sure that parts replaced function properly before the machine cover is reinstalled. Presently, in order to carry out the repair/maintenance work, a jumper wire must be connected for each interlock switch in order to bypass the switch. This is not only a tedious but also an inconvenient process since the jumper wires can be accidentally disconnected or damaged when work is performed on the machine.

It is therefore an object of the present invention to provide an interlock switch that does not require the use of a jumper wire when power to a machine must be maintained such as that required by a conventional interlock switch.

It is another object of the present invention to provide an interlock switch that is equipped with a latch key and a stop ring that are adapted for engaging each other.

It is a further object of the present invention to provide an interlock switch that can be latched into a permanently engaged position by locking a latch key on the shaft of the switch against a stop ring located on the housing of the switch.

It is another further object of the present invention to provide an interlock switch that further includes an indicator lamp for providing visual indication when the switch is not engaged between the latch key and the stop ring.

It is yet another object of the present invention to provide an interlock switch that can be permanently engaged to provide power to the machine even though a machine cover is removed to facilitate a repair or maintenance work to be performed on the machine.

It is still another object of the present invention to provide an interlock switch for use in a semiconductor process machine such that the machine can be serviced even when the machine cover is removed by a service personnel.

SUMMARY OF THE INVENTION

In accordance with the present invention, an interlock switch that can be permanently latched into an engaged position is provided by the inclusion of a latch key on the shaft and a stop ring on the housing of the switch such that the latch key can be locked against the stop ring to provide a permanent engagement of the switch. The present invention interlock switch may further include an indicator lamp for providing a visual indication when the switch is disengaged and that power supply to the machine is cut-off.

In a preferred embodiment, an interlock switch that can be latched into a permanently engaged position is provided which includes a body of generally elongated shape containing a cavity therein, the cavity is sealed at the top by a top plate that has an aperture therethrough, a shaft of generally elongated shape that has an outside dimension smaller than a dimension of the aperture such that at least part of the shaft is positioned inside the cavity through the aperture, a spring positioned inside the cavity for providing an outward force against the shaft relative to the cavity, a latch key on the shaft that has a predetermined width, a stop ring that is concentric with and mounted to the top plate adjacent to the aperture, the ring has an inside dimension larger than the outside dimension of the shaft and an opening adapted to allow the latch key on the shaft to pass through, and a switch means mounted on the top plate of the body capable of being triggered into an "OFF" position by a triggering means mounted on the shaft such that when the shaft is pressed into the cavity against the spring by passing the latch key through the opening in the stop ring, and subsequently turning the key to lock against the stop ring.

In another preferred embodiment, an interlock switch that can be latched into a permanently engaged position is provided which includes a body of generally cylindrical shape containing a cavity therein, the cavity is sealed at the top by a top plate that has an aperture therethrough, a shaft of generally elongated shape that has an outside dimension smaller than a dimension of the aperture such that at least part of the shaft is positioned inside the cavity through the aperture, a spring positioned inside the cavity for providing an outward force against the shaft relative to the cavity, a latch key on the shaft that has a predetermined width, a stop ring that is concentric with and mounted to the top plate adjacent to the aperture, the ring has an inside dimension larger than the outside dimension of the shaft and an opening adapted to allow the latch key on the shaft to pass through, and a switch means mounted on the top plate of the body capable of being triggered into an "OFF" position by a triggering means mounted on the shaft when the shaft is pressed into the cavity, and a lamp electrically connected to the switch means to turn on when the switch means is not triggered into an "OFF" position.

The present invention is also directed to a method of servicing a machine that is equipped with interlock switches under an outer cover of the machining by the operating steps of first providing an interlock switch that has a body of generally cylindrical shape having a cavity therein, said cavity being sealed at the top by a top plate having an aperture therethrough, a shaft of generally cylindrical shape having an outside dimension smaller than a dimension of the aperture such that at least part of the shaft is positioned inside the cavity through the aperture, a spring positioned inside the cavity for providing an outward force against the shaft relative to the cavity, a latch key on the shaft having a predetermined width, a stop ring concentric with and mounted to said top plate adjacent to said aperture having an inside dimension larger than the outside dimension of the shaft, the stop ring having an opening adapted to allow the latch key on the shaft to pass therethrough, a switch means mounted on the top plate of the body capable of being triggered into an "OFF" position by a triggering means mounted on the shaft when the shaft is pressed into the cavity, then mounting the interlock switch in a process machine in such a way that the cover of the machine would press down on the shaft of the interlock switch, then connecting electrically the interlock switch in series with a power supply line for the process machine, and then pressing down the shaft of the interlock switch and turning the shaft such that the latch key is locked under the stop ring and the switch means is triggered into an "OFF" position.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention provides a novel latchable interlock switch that can be installed under a cover of a process machine for shutting off a power supply to the machine when the cover is removed wherein the switch can be latched into a permanently engaged position and optionally may be equipped with an indicator lamp such that power remains on even when the machine cover has been removed to facilitate a repair or maintenance procedure to be conducted on the machine.

Figure 1:
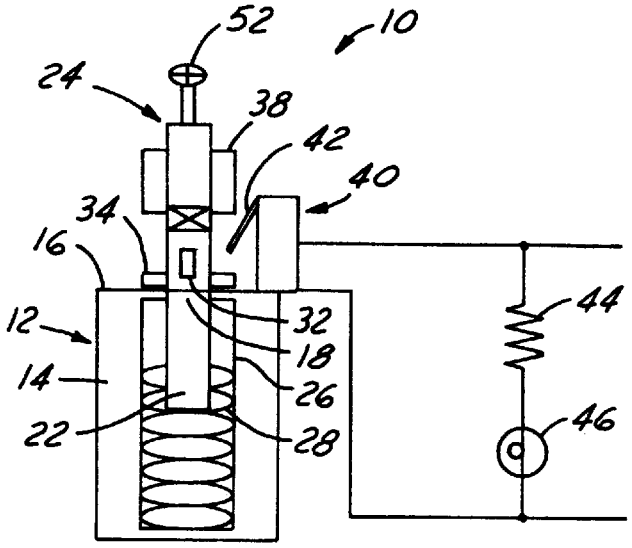
FIG. 1 is a schematic showing the present invention latchable interlock switch connected to an indicator lamp in a disengaged position.

In a preferred embodiment, as shown in FIG. 1, a present invention latchable interlock switch 10 is shown. The interlock switch 10 is constructed mainly of a body member 12 that is of generally elongated shape (or cylindrical shape) containing a cavity 14 therein. The cavity 14 is sealed at the top by a top plate 16 which has an aperture 18 therethrough. A second major component of the interlock switch 10 is a shaft member 24. The shaft member 24 is generally of an elongated shape (or cylindrical shape) and has an outside dimension smaller than a dimension of the aperture 18. The shaft member 24 is therefore designed such that at least the bottom part 22 of the shaft member 24 is positioned inside the cavity 14 and an inner body member 26 which contains a spring 28. Spring 28 is fixed to the bottom 22 of the shaft member 24 to provide an outward force against the shaft member 24 away from the cavity 14.

Figure 2:
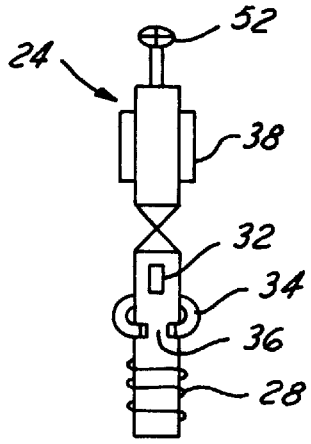
FIG. 2 is an enlarged view of the shaft member in relation to a stop ring in a disengaged position.

A latch key 32 is provided on the shaft member 24 with a predetermined width. A stop ring 34 which has a notch opening 36 (as shown in FIG. 2) is mounted concentric to the top plate 16 of the body member 12 adjacent to the aperture 18. The stop ring 34 has an inside dimension that is larger than the outside dimension of the shaft member 24 to allow the latter to penetrate therethrough. The notch opening 36 in the stop ring 34 is adapted for allowing the latch key 32 located on the shaft member 24 to pass through.

A switch means 40 can be mounted to the top plate 16 of the body portion 12 which is capable of being triggered into an "OFF" position by a triggering means 38 mounted on the shaft member 24. The triggering means 38 can be a concentric ring mounted on the shaft member 24 which has an outside diameter sufficiently large in order to trip an arm 42 of the switch means 40. The switch means 40 can be conveniently a microswitch that requires only a minimal amount of force to trip the arm 42 to turn the switch into an "OFF" position. The switch means 40 is further connected in series to a power supply line (not shown) of a machine in which the interlock switch is installed.

Figure 3:
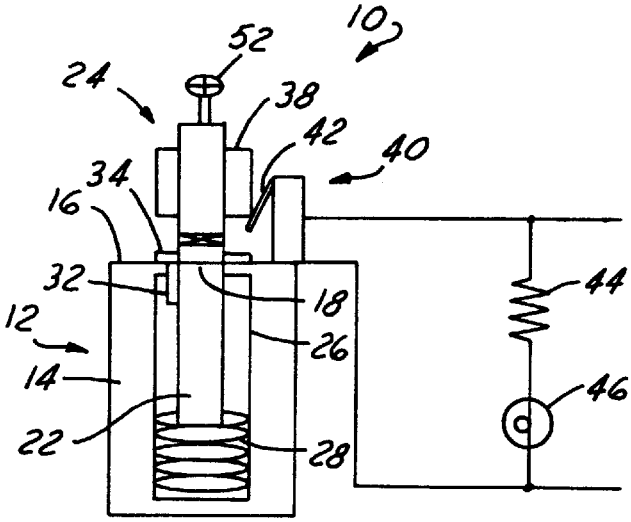
FIG. 3 is a schematic of the present invention latchable interlock switch connected to an indicator lamp in an engaged position.
Figure 4:
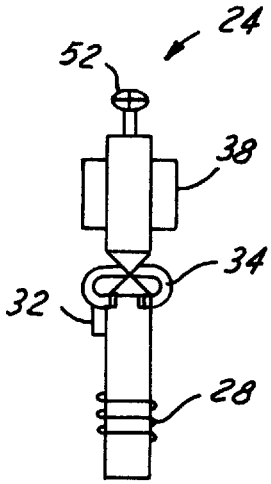
FIG. 4 is a enlarged view of the shaft member engaging the stop ring wherein the shaft is turned 90 degrees.

The switch means 40 may optionally include an indicator lamp 46 and a resistor 44 of high resistance connected in series with the power supply line. The shaft member 24 may further include a turning means 52 for frictionally engaging and turning the shaft in relation to the body member 12 such that the latch key 32 can be locked under the stop ring 34. This is shown in FIGS. 3 and 4. The turning means 52 can be conveniently provided as a cross-head screw such as that shown in FIG. 1. However, any other means that provides frictional engagement with the tip of the shaft member 24 may function equally well. For instance, serrated sections (not shown) can be provided to the tip of the shaft member 24 to provide easy gripping and turning by fingers. The cross-head screw 52 shown in FIG. I can be conveniently turned by a screw driver.

FIG. 2 shows an enlarged view of the shaft member 24, the stop ring 34 and the spring 28 in a disengaged position. The spring 28 is in a relaxed mode and not compressed. The latch key 32 on the shaft member 24 can be a protruded key that is welded to the shaft member 24. The width of the latch key 32 is designed such that it will pass through the opening 36 in the stop ring 34 when the shaft member 24 is pushed down into an engaged position.

Referring now to FIG. 3, wherein the present invention novel interlock switch 10 is presented in an engaged, or activated position. It is seen that the arm 42 of the switch means (or the microswitch) 40 is pushed down by the trigger means 38 such that the switch means is in an "OFF" position. This is achieved by pushing down the shaft member 24 on the cross-head screw 52 against the spring 28 such that the latch key 32 first clears through the opening 36 in the stop ring 34, and then turning the shaft member 24 to an angle of larger than approximately 30 degrees such that the latch key 32 is locked under the stop ring 34. When the switch means 40 is in an "OFF" position, the indicator lamp 46 is off such that it indicates the power supply to the machine is not interrupted. The indicator lamp 46 can be mounted in any convenient positions, for instance, next to or as part of an interlock switch, or alternatively, in the control panel of the process machine.

When a plurality of interlock switches are used in a process machine, each indicator lamp can be numbered such that they can be readily identified and traced to the corresponding interlock switch that is disengaged with the indicator lamp turned on. The resistor 44 used, as shown in FIGS. 1 or 3, is usually of high resistance such that the magnitude of a current flowing through the circuit is greatly reduced such that while the current is not enough to start the system(i.e., the process machine), it is enough to turn the indicator lamp on. This informs a machine operator that the interlock switch is not engaged and that the process machine can not be turned on. The system can be started when there is a short circuit by an engagement between the latch key 32 and the stop ring 34, i.e., when the interlock switch is activated into an engaged position.

An enlarged view of the shaft member 24 engaging the stop ring 34 is shown in FIG. 4. It is seen that after the shaft member 24 has been pushed down and turned to an angle of larger than approximately 30 degrees, the latch key 32 is locked under the stop ring 34 against a compressed spring 28. At such position, the triggering means 38 turns on the microswitch 40 to allow a short circuit and a power supply to flow through the process machine while leaving the indicator lamp 46 off.

Figure 5A:
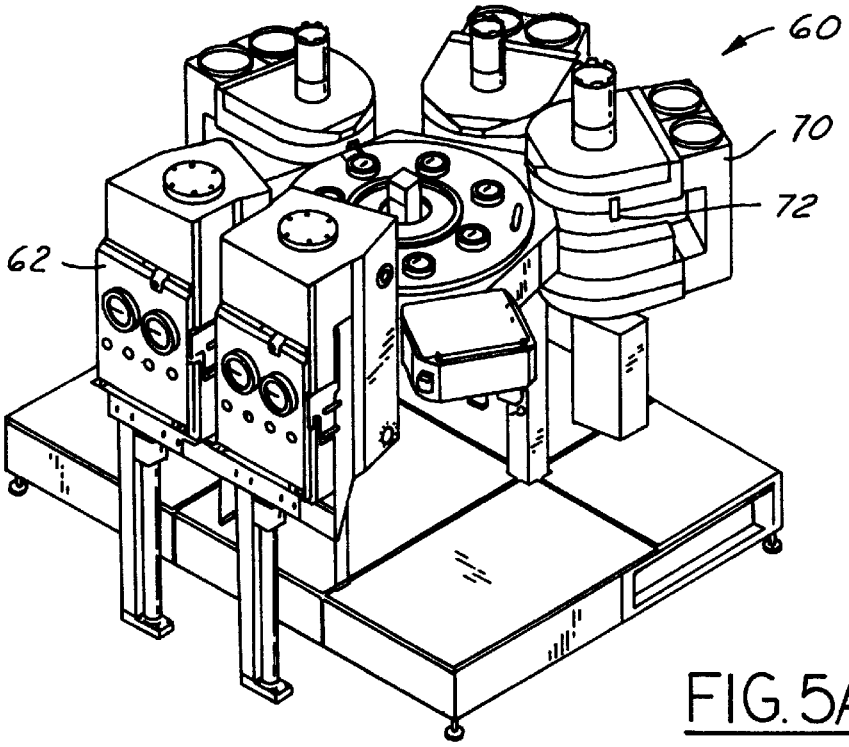
FIGS. 5A and 5B are illustrations of the present invention latchable interlock switch installed in a process machine.
Figure 5B:
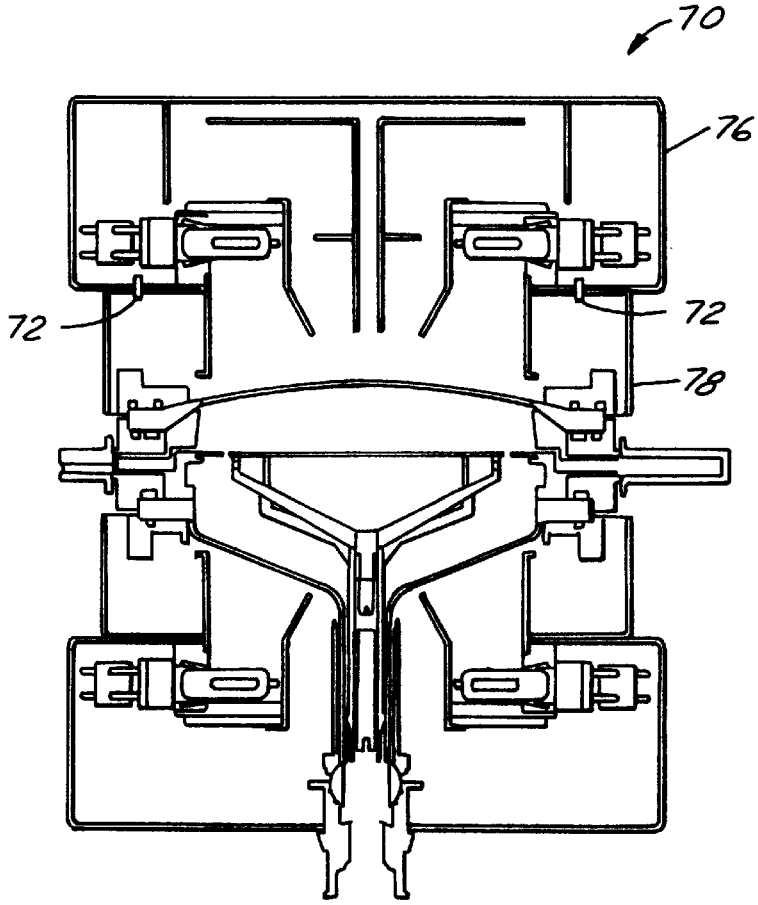

FIGS. 5A and 5B are illustrations of the present invention latchable interlock switch 72 installed in a process machine 60. The process machine 60 is equipped with a control panel 62 and a plurality of interlock switches 72. The switches 72 effectively indicate whether the cover 70 of the process machine 70 is properly closed on the body 78 of the machine.

It should be noted that while an indicator lamp 46 is used in an illustration of the present invention preferred embodiment, any other indicating devices including that of a buzzer alarm can be suitably used in place of the lamp. It should also be noted that the present invention latchable interlock switch can be installed in any kind of electrically operated machines, other than those used in the semiconductor processing trade. The latchable interlock switch provides significant benefits over a conventional interlock switch wherein a jumper wire must be used in order to short circuit the interlock switch when the operation of the machine must be maintained.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. An interlock switch capable of being latched into a permanently engaged position comprising:

a body of generally elongated shape having a cavity therein, said cavity being sealed at a top by a top plate having an aperture therethrough, a shaft of generally elongated shape having an outside dimension smaller than a dimension of said aperture such that at least part of the shaft is positioned inside the cavity through the aperture, a spring positioned inside said cavity for providing an outward force against the shaft away from the cavity, a latch key on the shaft having a predetermined width, a stop ring concentric with and mounted to said top plate adjacent to said aperture having an inside dimension larger than the outside dimension of said shaft, said stop ring having an opening for allowing the latch key on the shaft to pass therethrough, and a switch means mounted on the top plate of said body capable of being triggered into an "OFF" position by a triggering means mounted on said shaft when said shaft is pressed into the cavity against the spring by passing the key through the opening of the stop ring and subsequently turning the key to lock against the stop ring.

2. An interlock switch according to claim 1 further comprising an indicator lamp electrically connected to the switch means for turning "OFF" when said switch is triggered into an "OFF" position.

3. An interlock switch according to claim 2, wherein said indicator lamp is connected in series with said switch means and a resistor for reducing the magnitude of the electrical current flowing through the lamp.

4. An interlock switch according to claim 1, wherein said switch means mounted on the top plate of the body is a microswitch.

5. An interlock switch according to claim 1 further comprising means provided at a top of the shaft for frictional engaging with and easy rotation of the shaft.

6. An interlock switch according to claim 5, wherein said means for providing frictional engagement with and easy rotation of the shaft is a cross-head screw.

7. An interlock switch according to claim 1, wherein said interlock switch is connected in series with a power supply line on a process machine.

8. An interlock switch according to claim 1 further comprising a stop on the shaft for retaining a lower portion of said shaft inside said body.

9. An interlock switch capable of being latched into a permanently engaged position comprising:

a body of generally cylindrical shape having a cavity therein, said cavity being sealed at a top by a top plate having an aperture therethrough, a shaft of generally cylindrical shape having an outside dimension smaller than a dimension of the aperture such that at least part of the shaft is positioned inside the cavity through the aperture, a spring position inside said cavity for providing an outward force against the shaft away from the cavity, a latch key on the shaft having a predetermined width, a stop ring concentric with and mounted to said top plate adjacent to said aperture having an inside dimension larger than the outside dimension of said shaft, said stop ring having an opening for allowing the latch key on the shaft to pass therethrough, a switch means mounted on the top plate of said body capable of being triggered into an "OFF" position by a triggering means mounted on said shaft when said shaft is pressed into the cavity, and a lamp electrically connected to said switch means to turn on when said switch means is not triggered into the "OFF" position.

10. An interlock switch according to claim 9, wherein said lamp is mounted on or adjacent to said interlock switch.

11. An interlock switch according to claim 9, wherein said lamp is mounted on a control panel of a process machine.

12. An interlock switch according to claim 9, wherein said switch is one of a plurality of interlock switches connected in series with a power supply line of a process machine.

13. An interlock switch according to claim 9, wherein said switch is mounted under a cover of a process machine for monitoring a status of said cover.

14. An interlock switch according to claim 9, wherein said switch allows a process machine to be inspected for a normal function when the cover of the machine is removed from a normal closed position.

15. A method of servicing process machine equipped with interlock switches under its cover by the operating steps of:

providing an interlock switch having a body of generally elongated shape having a cavity therein, said cavity being sealed at a top by a top plate having an aperture therethrough, a shaft of generally elongated shape having an outside dimension smaller than a dimension of said aperture such that at least part of the shaft is positioned inside the cavity through the aperture, a spring positioned inside said cavity for providing an outward force against the shaft relative to the cavity, a latch key on the shaft having a predetermined width, a stop ring concentric with and mounted to said top plate adjacent to said aperture having an inside dimension larger than the outside dimension of said shaft, said stop ring having an opening for allowing the latch key on the shaft to pass therethrough, a switch means mounted on the top plate of said body capable of being triggered into an "OFF" position by a triggering means mounted on said shaft when said shaft is pressed into the cavity against the spring by passing the key through the opening of the stop ring and subsequently turning the key to lock against the stop ring, mounting said interlock switch in a process machine, connecting electrically said interlock switch in series with a power supply line for said process machine, and pressing down the shaft of the interlock switch and turning the shaft such that the latch is locked under said stop ring and the switch means is triggered into an "OFF" position.

16. A method according to claim 15 further comprising the step of mounting a plurality of interlock switches in a process machine.

17. A method according to claim 15 further comprising the step of electrically connecting a lamp to said switch means such that the lamp is off when said switch means is in an "OFF" position.

18. A method according to claim 15 further comprising the step of electrically connecting a lamp to the switch means such that the lamp is on when the switch means is in an "ON" position.

* * * * *